US009593536B2

(12) United States Patent
Vestavik et al.

(10) Patent No.: US 9,593,536 B2
(45) Date of Patent: Mar. 14, 2017

(54) CASING DRILLING SYSTEM AND METHOD

(71) Applicant: Reelwell, A.S., Royneberg (NO)

(72) Inventors: Ola M. Vestavik, Fosnavåg (NO); Morten Olav Meling, Stavanger (NO); Stein Erik Meinseth, Stavanger (NO)

(73) Assignee: Reelwell, AS, Royneberg (NO)

( * ) Notice: Subject to any disclaimer, the term of this patent is extended or adjusted under 35 U.S.C. 154(b) by 306 days.

(21) Appl. No.: 14/273,597

(22) Filed: May 9, 2014

(65) Prior Publication Data

US 2015/0322721 A1 Nov. 12, 2015

(51) Int. Cl.

| | |
|---|---|
| ***E21B 7/20*** | (2006.01) |
| ***E21B 21/00*** | (2006.01) |
| ***E21B 21/10*** | (2006.01) |
| ***E21B 21/12*** | (2006.01) |
| ***E21B 3/02*** | (2006.01) |
| ***E21B 19/06*** | (2006.01) |

(52) U.S. Cl.

CPC ..... *E21B 7/20* (2013.01); *E21B 3/02* (2013.01); *E21B 19/06* (2013.01); *E21B 21/00* (2013.01); *E21B 21/10* (2013.01); *E21B 21/12* (2013.01)

(58) Field of Classification Search

CPC ..... E21B 21/103; E21B 21/10; E21B 7/20
See application file for complete search history.

(56) References Cited

U.S. PATENT DOCUMENTS 2,606,002 A * 8/1952 Larson ..... E21B 7/00 166/381
2,915,127 A * 12/1959 O'Farrel ..... E21B 27/00 166/154
3,059,619 A * 10/1962 Beaumont ..... E21B 4/14 173/138
3,225,841 A * 12/1965 Thompson ..... E21B 4/14 173/137
3,734,212 A * 5/1973 Perlewitz ..... E21B 7/20 173/197

(Continued)

FOREIGN PATENT DOCUMENTS

GB 2416791 A 2/2006

OTHER PUBLICATIONS

Vestavik, O. M., Brown, S. C., & Kerr, S. P. (Jan. 1, 2009). Reelwell Drillilng Method. Society of Petroleum Engineers.

(Continued)

*Primary Examiner* — Shane Bomar
(74) *Attorney, Agent, or Firm* — Richard A. Fagin

(57) ABSTRACT

A casing drilling system includes combination conduit of a casing and a pipe inside the casing. A first adapter has a flow diverter to redirect at least flow of drilling fluid returning from a bottom of a wellbore to either an interior of the pipe or an annular space between the casing and the pipe. A second adapter has a flow diverter to redirect flow of drilling fluid into the conduit through the other one of the interior of the pipe and the annular space. The second adapter has a fluid connection between either the interior of the pipe or the annular space and a rotationally fixed fluid outlet. The system includes a casing chuck having means to support the casing and a slidable conduit operable to expose an uppermost end of the casing and a connection between the second adapter and an uppermost end of the pipe.

14 Claims, 6 Drawing Sheets

(56) References Cited

U.S. PATENT DOCUMENTS

| | | | | |
|---|---|---|---|---|
| 5,207,283 | A * | 5/1993 | Lay | E21B 4/14 175/296 |
| 6,401,822 | B1 * | 6/2002 | Baugh | E21B 21/10 166/154 |
| 7,108,080 | B2 * | 9/2006 | Tessari | E21B 7/20 175/21 |
| 8,276,689 | B2 * | 10/2012 | Giroux | E21B 7/20 175/171 |
| 2003/0089505 | A1 * | 5/2003 | Pluchek | E21B 21/10 166/386 |
| 2004/0256157 | A1 * | 12/2004 | Tessari | E21B 7/20 175/57 |
| 2005/0000691 | A1 | 1/2005 | Giroux et al. | |
| 2011/0180269 | A1 * | 7/2011 | Vestavik | E21B 21/10 166/373 |
| 2011/0240285 | A1 * | 10/2011 | Vestavik | E21B 34/12 166/188 |
| 2016/0237750 | A1 * | 8/2016 | Purohit | E21B 23/04 |

OTHER PUBLICATIONS

Belarde, M. A., & Vestavik, O. M. (Jan. 1, 2011). Deployment of Reelwell Drilling Method in Shale Gas field in Canada. Society of Petroleum Engineers.

International Search Report and Written Opinion of the International Searching Authority from PCT/IB2015/053197, Sep. 30, 2015.

* cited by examiner

CASING DRILLING SYSTEM AND METHOD

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND

This disclosure is related to the field of drilling wellbores through subsurface formations. More specifically, the disclosure relates to methods and systems for simultaneous drilling of a wellbore while inserting a protecting pipe or casing into the drilled wellbore.

Wellbore drilling through subsurface formations known in the art includes so-called "casing drilling" or "casing while drilling" systems and methods. Such systems and methods enable simultaneous drilling of a wellbore through the formations and insertion into the drilled wellbore of a protective pipe or casing. The casing may be cemented in place after the wellbore is drilled to its intended depth, and serves, among other functions, to protect the mechanical integrity of the wellbore and to provide hydraulic isolation between formations traversed by the wellbore.

Casing while drilling systems known in the art are described, for example, in U.S. Pat. No. 8,534,379 issued to Giroux et al., U.S. Pat. No. 7,624,820 issued to Angman et al. and U.S. Pat. No. 7,475,742 issued to Angman et al. In casing drilling methods and systems known in the art, the casing may be used to transport drilling fluid ("mud") from the surface to a drill bit disposed at an end of a bottom hole assembly (BHA) consisting of various drilling and hole diameter enlarging (underreaming) tools. As the drill bit lengthens the wellbore, and the underreamer enlarges the wellbore diameter to enable movement of the casing therethrough, drill cuttings are lifted and transported by the drilling mud from the bottom of the wellbore and the position of the underreamer to the surface through an annular space ("annulus") between the casing and the wellbore. Some casing drilling systems may omit the use of an underreamer. See, e.g., the Giroux et al. '379 patent referred to above.

As is well known in the art, it may be undesirable to have a large annulus in order to provide good conditions for later cementing of the casing in the wellbore. Having a relatively small annulus, however, makes transport of the cuttings to the surface more difficult and may even increase the risk that the casing becomes stuck in the wellbore before reaching the intended well depth.

DETAILED DESCRIPTION

Figure 1:
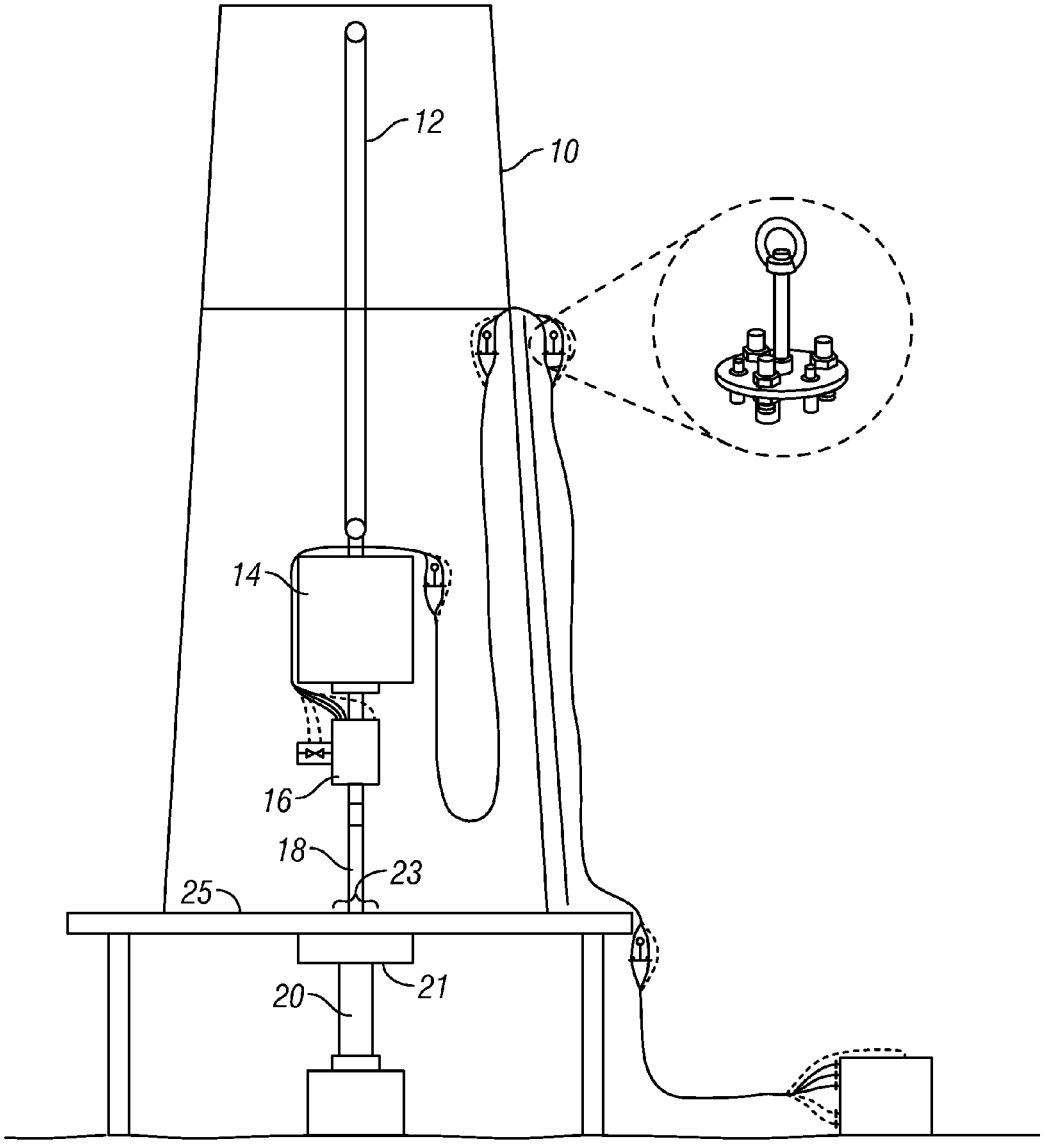
FIG. 1 shows using an example casing drilling system to drill wellbore.

FIG. 1 shows an example casing drilling being used to drill a wellbore through subsurface formations, while simultaneously inserting a protective pipe or casing therein. A combination conduit 18, which may include an inner pipe (FIG. 2) consisting of conventional, threadedly coupled drill pipe, tubing or coiled tubing, known in the art may be disposed inside a casing (FIG. 2) forming an outer pipe thereof. The combination conduit 18 provides at least one inner fluid flow path (FIG. 2A) and an outer flow path (FIG. 2A). In the present example, drilling fluid may be pumped through a top drive 14 of any type known in the art into a top drive adapter 16 coupled thereto. The top drive adapter 16 may be connected to the combination conduit 18.

The top drive adapter 16 may be supported by a derrick 10 with drawworks 12 of types well known in the art used in wellbore drilling procedures. Drilling fluid pumps and connections to the top drive and top drive adapter 16 are omitted from FIG. 1 for clarity of the illustration.

The combination conduit 18 may be rotated by the top drive 14. Such rotation may be ultimately communicated through the combination conduit 18 to a drill bit at a bottom end thereof for drilling a wellbore, as will be explained in more detail with reference to FIG. 7.

A riser 20 or similar surface pipe may be set in the wellbore to a selected depth and provide control of fluid leaving the wellbore using a rotating control device 21 or similar pressure control element coupled to an upper end of the riser. An opening 23 in a floor 25 of the derrick 10 may provide a place to support the weight of the combination conduit 18 during assembly of additional segments thereto or removal of segments therefrom by using "slips" (not shown in FIG. 1) of types well known in the art.

Figure 2:
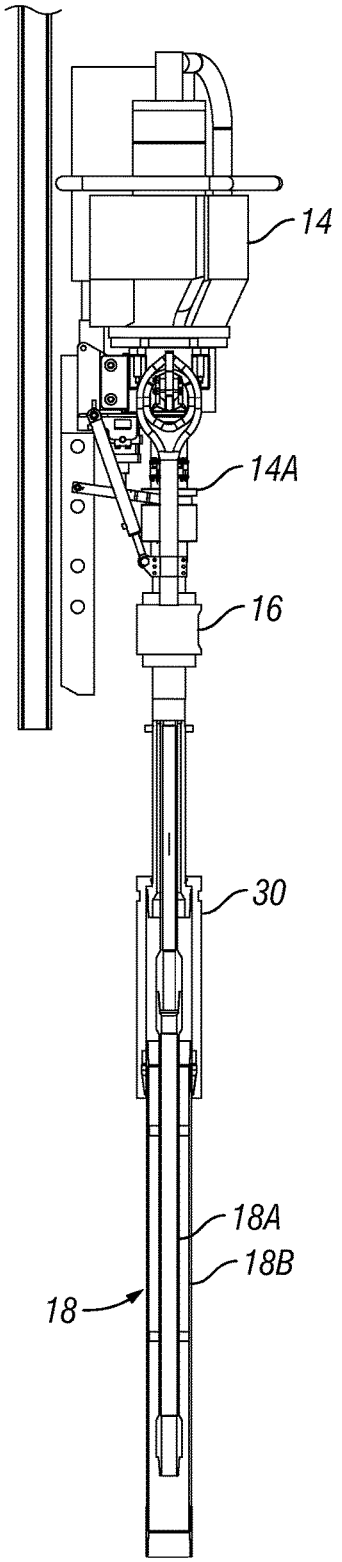
FIG. 2 shows above the well components of an example casing drilling system.
Figure 2A:
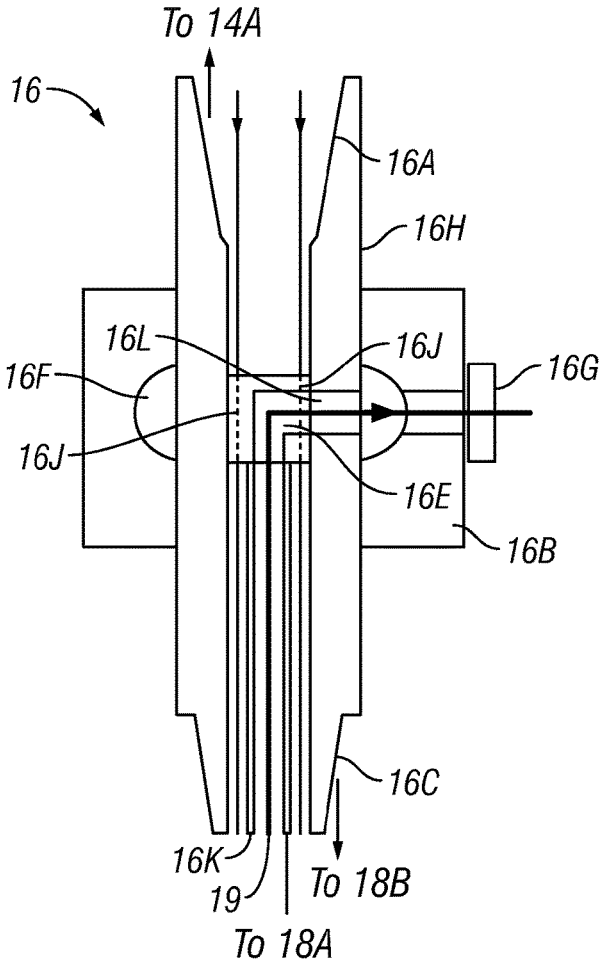
FIG. 2A shows a functional cross section of a top drive adapter in an example casing drilling system.

FIG. 2 shows the top drive 14, the top drive adapter 16, the inner pipe 18A (e.g., drill pipe or tubing) in the combination conduit 18 and the casing 18B in the combination conduit 18 in more detail. A casing chuck 30, as will be explained with reference to FIG. 3, may be coupled between the top drive adapter 16 and the uppermost segment of the combination conduit 18 to enable access to both the inner pipe 18A and the casing 18B for assembly and disassembly thereof. In the present example, drilling fluid flow from the top drive quill 14A (which also provides rotation to the combination conduit) is directed to an annular space between the inner pipe 18A and the outer pipe (casing) 18B. Fluid returning from the wellbore as it is drilled, washed, reamed or circulated may be returned through an interior passage inside the inner pipe 18A and discharged through a suitable, rotationally fixed outlet (FIG. 2A) in the top drive adapter.

Figure 3:
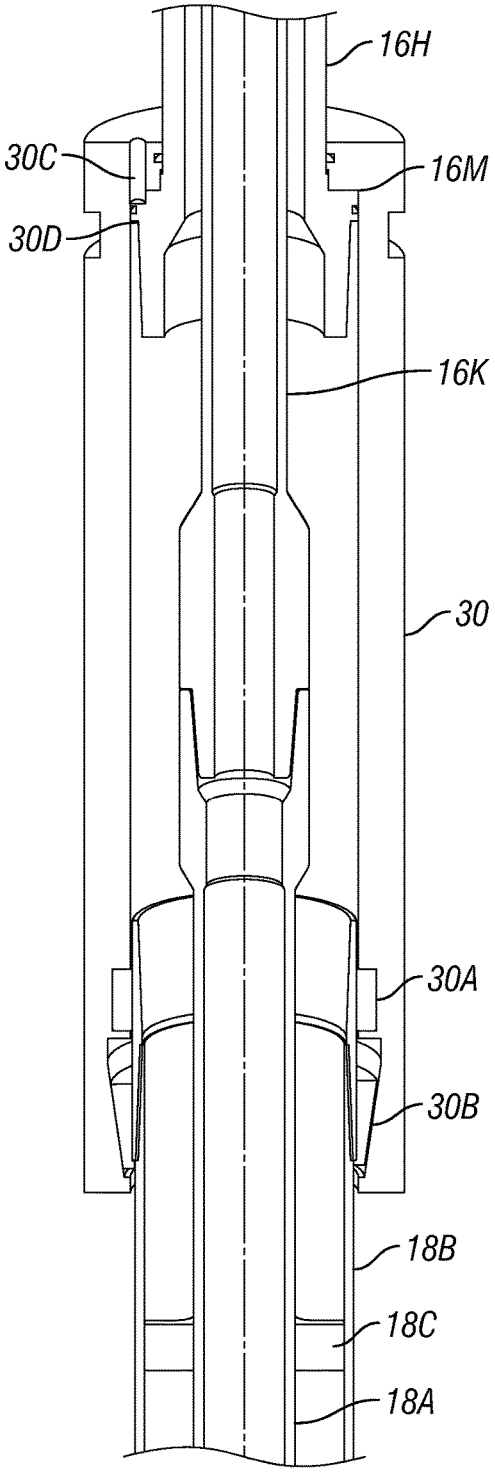
FIG. 3 shows an example casing chuck that may be used in some embodiments to make connections of drill pipe and/or casing.

FIG. 2A shows a functional cross section of the top drive adapter 16 in more detail to show the mechanical and fluid path connections between the top drive quill (14A in FIG. 2) and the combination conduit (18 in FIG. 2). An upper threaded connection 16A may be configured to threadedly connect to the end of the quill (14A in FIG. 2). Drilling fluid flow into the upper threaded connection 16A is indicated by downwardly pointing arrows inside the upper threaded connection 16A. The quill (14A in FIG. 2) may be similar in configuration to any quill used in a top drive for drilling with conventional drill pipe. The upper threaded connection 16A may be formed in a drive tube 16H, which transmits rotation of the quill (14A in FIG. 2) to a lower threaded connection 16C. The lower threaded connection 16C may be configured to accept threading to an hydraulic lift tube (FIG. 3).

A flow diverter 16E may be disposed at a selected position along the interior of the drive tube 16H. The flow diverter may include passages 16J that enable downward flow of the drilling fluid entering the upper part of the drive tube 16H to pass into an annular space between the inside of the drive tube 16H and a drill pipe connector 16K. As will be explained with reference to FIG. 3, such downward flow may then enter an annular space between the inner pipe and the outer pipe of the combination conduit (18 in FIG. 2). The flow diverter 16E may have a drill pipe connector 16K connected to a bottom end thereof. As will be explained below with reference to FIG. 3, the drill pipe connector may threadedly engage the inner pipe of the combination conduit (18 in FIG. 2). Fluid flowing up the inner pipe, shown at 19 when returned from the wellbore, enters a center portion of the flow diverter 16E. The center portion of the flow diverter 16E may include a transversely directed port that is in fluid communication with a corresponding port 16L in the drive tube 16H. A collar 16B may be sealingly, rotatably coupled to the exterior of the drive tube 16H at the longitudinal position of the port 16L. The collar 16B may include a full interior circumference channel 16F to provide fluid communication to the port 16L irrespective of the rotational orientation of the drive tube 16H. The collar 16B may thus remain rotationally fixed while the drive tube 16H is rotated by the quill (14A in FIG. 2). A port 16G in the collar 16B may provide a connection for drilling fluid being discharged from the well through the collar 16B.

It may be desirable that the flow diverter 16E is rotationally fixed within the drive tube so that torque applied to the drive tube 16H may be efficiently transmitted to the drill pipe connector 16K as will be further explained with reference to FIG. 3. In some embodiments, the inner pipe may contain more than one flow channel, for example for downhole chemical injection, pressure control and similar applications. In such examples, additional flow diverters may be provided for each of the flow channels.

To summarize, the top drive adapter makes rotational and fluid connection to the top drive quill (14A in FIG. 2) and enables diversion of downward flowing drilling fluid into an annular space between the inner pipe and the outer pipe of the combination conduit (18 in FIG. 2). The top drive adapter 16 further enables rotation while maintaining a rotationally fixed, fluidly coupled connection to the interior passage of the inner pipe in the combination conduit (18 in FIG. 1), thus enabling discharge of fluid from the wellbore therethrough. It should be clearly understood that the present example configuration of the top drive adapter 16 is only meant to serve as an example of configurations of a top drive adapter. It is equally within the scope of the present disclosure for the downward flowing drilling fluid to be directed to the interior of the inner pipe, with return fluid being directed to the annular space between the inner pipe and the outer pipe of the combination conduit (18 in FIG. 1). It should also be clearly understood that a similar adapter may be used with kelly/rotary table drill pipe rotation systems known in the art. In such examples, an adapter configured substantially as shown in FIG. 2A may be threadedly coupled to the drill pipe connection at the base of the kelly; fluid flow may be directed substantially as explained with reference to the example top drive adapter as explained above.

Referring to FIG. 3, an example connection between the top drive adapter and the combination conduit, referred to as a "casing chuck" 30 will be explained in more detail. The casing chuck 30 may be formed from materials similar to those used to make drill pipe and casing. The casing chuck 30 may have a substantially cylindrical inner surface; the shape of the outer surface may also be cylindrical but the exact shape of the outer surface is not functionally related to operation of the casing chuck 30. Proximate a lower, open end of the casing chuck 30, an interior surface thereof may include sealing elements 30A that provide a fluid tight seal between the casing chuck 30 and the casing 18B (i.e., the outer pipe in the combination conduit 18). Axial loading of the casing 18B may be supported by gripping elements 30B disposed in the interior of the casing chuck 30. The gripping elements 30B may be similar in configuration to conventional pipe slips used to grip drill pipe or casing being supported at the opening in the drill floor (see FIG. 1). An interior surface of the casing chuck 30 at the position of the gripping elements 30B may be tapered such that axial tension on the casing 18B causes the gripping elements 30B to be compressed against the casing 18B, thus enhancing the axial load carrying force exerted by the gripping elements. The drill pipe connector 16K is shown as threadedly coupled to an uppermost segment ("joint") of the drill pipe 18A (i.e., the inner pipe in the combination conduit 18). In the present example, centralizers, such as shown at 18C may be used to keep the drill pipe 18A approximately coaxial with the casing 18B, however in other examples the centralizers 18C may be omitted.

The drive tube 16H is shown in FIG. 3 as having an internal flange 16M that cooperates with a corresponding flange 30D on the upper end of the casing chuck 30. The flange 16M may be sealingly engaged to the interior wall of the casing chuck 30. In the present example, a fluid port 30C may be provided through the corresponding flange 30D in the casing chuck 30, so that application of hydraulic or pneumatic pressure to the fluid port 30C may cause the casing chuck 30 to lift relative to the drive tube 16H by action of the pressure in the space between the internal flange 16M and the corresponding flange 30D. A similar fluid port may also be integrated into the drive tube 16H. It will also be appreciated that the annular space between the drive tube 16H and the drill pipe connector 16K provides a flow path for drilling fluid moving downwardly as explained with reference to FIG. 2A. Such downwardly flowing fluid may enter the annular space between the drill pipe 18A and the casing 18B by flowing through the casing chuck 30. Seals on the internal flange 16M and the seal 30A constrain the fluid to flow from the annular space in the drive tube 16H to the annular space between the drill pipe 18A and the casing 18B.

The drive tube 16H and the opening therefor in the casing chuck 30 may have corresponding torque transmitting features, 16HH and 30DD to enable rotational energy transmitted to the drive tube 16H by the top drive (14 in FIG. 2) or kelly (if a kelly/rotary table is used) to be transferred to the casing chuck 30 and thereby to the casing 18B. An example of torque transmission features that may be used to perform the foregoing described function may be better understood with reference to FIG. 3B. The drive tube 16H may include a passage 16Q extending longitudinally along the wall thereof for communication of hydraulic or pneumatic pressure to lift the casing chuck 30 as explained with reference to FIG. 3. The passage 16Q in the present example may substitute or may supplement the passage shown at 30C in FIG. 3. In the present example, one or more pins 30D may extend from an inner surface of the part of the casing chuck 30 which surrounds the drive tube 16H and forms the positive stop therefor as explained with reference to FIG. 3. A corresponding bore 16P may be formed in the upper surface of the flange 16M in the drive tube 16H. Rotational energy from the drive tube 16H is thus conducted to the casing chuck 30, and ultimately to the casing (through the gripping elements as explained with reference to FIG. 3).

When it becomes necessary or desirable to disconnect the top drive adapter (16 in FIG. 2) from the uppermost segments of the casing 18B and/or the drill pipe 18A, one example procedure may include the following. First, the drawworks (12 in FIG. 1) are operated to lower the top drive (14 in FIG. 2) while casing slips (not shown) are inserted into the opening (23 in FIG. 1) in the derrick floor (25 in FIG. 1). The axial loading of the combination conduit 18 will then be supported by the casing 18B in the slips (not shown). A small further downward movement of the top drive (14 in FIG. 2) may cause the gripping elements 30B to release from the casing 18A. Pressure may then be applied to the port 30C, thereby lifting the casing chuck 30. When the casing chuck 30 is lifted, the connection between the drill pipe connector 16K and the uppermost joint of the drill pipe 18A will be accessible.

Figure 3A:
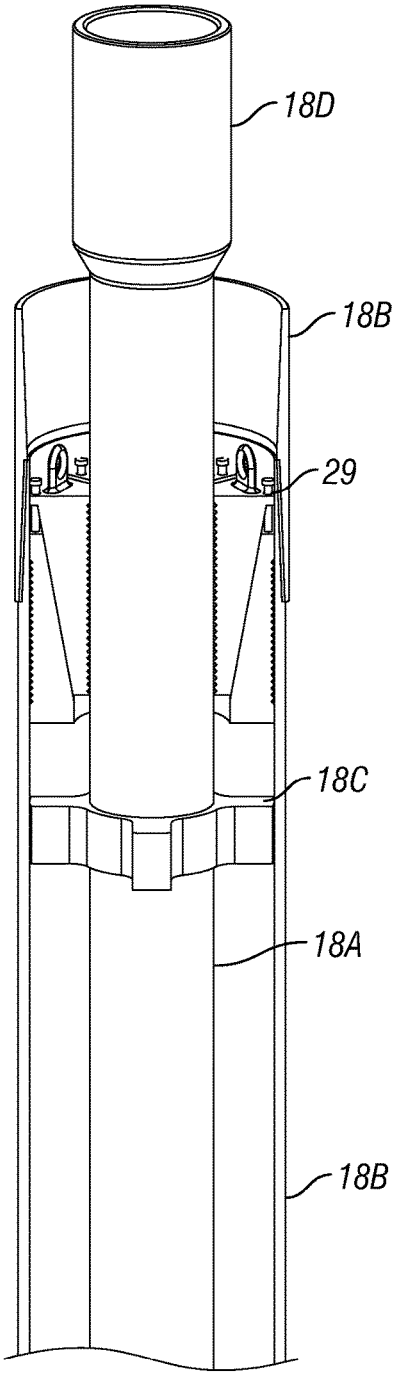
FIG. 3A shows supporting an inner pipe inside an outer pipe when a top drive is removed from connection therewith.
Figure 3B:
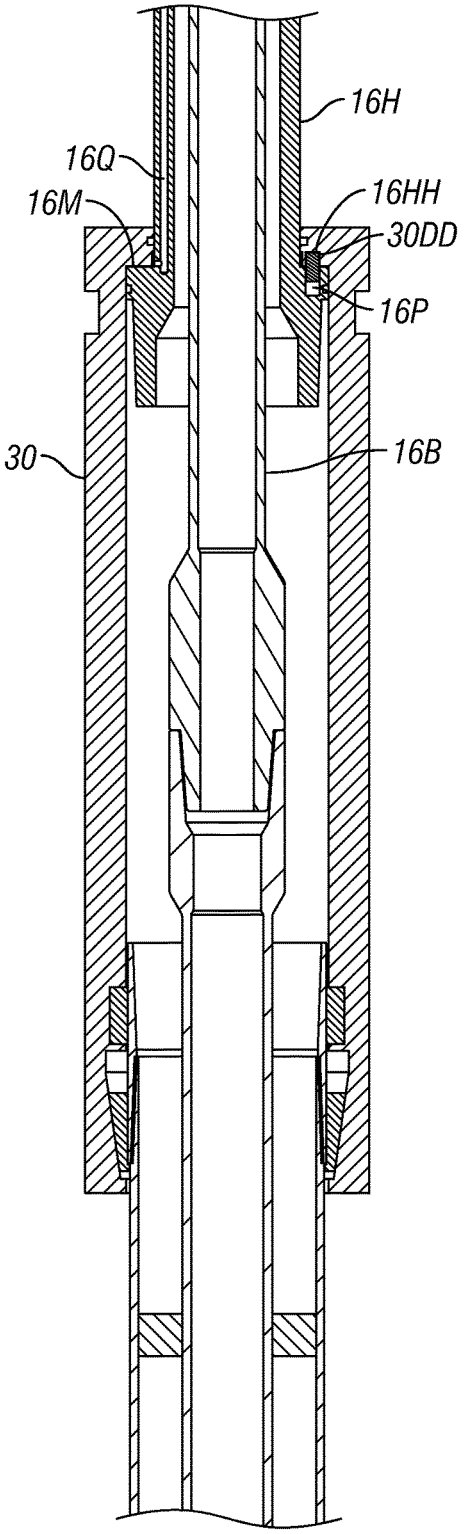
FIG. 3B shows an example of a casing chuck including torque transmission features to enable transmission of torque from a drive tube to the casing.

Referring to FIG. 3A, after the casing 18B is set in the slips (not shown) and the casing chuck (30 in FIG. 3) is lifted, the drill pipe 18A may be supported axially inside the casing 18B using slips 29 or other similar movement actuated gripping device. With the axial load of the casing 18B and the drill pipe 18A thus fully supported, it is then possible to disengage the top drive (16 in FIG. 2) to expose the uppermost connection 18D on the drill pipe 18A. At this time, it may be possible to assemble additional joints or stands (assemblies of two or more individual joints) to the casing 18B and/or the drill pipe 18A to enable further casing drilling of the wellbore. Once the additional stands or joints are assembled to the casing 18B and drill pipe 18A, the drill pipe connector 16K may be reconnected to the drill pipe 18A, the slips 29 may be removed. The casing chuck (30 in FIG. 3) may be reengaged to the uppermost casing joint, the entire assembly may be lifted to enable removing the slips from the derrick floor (25 in FIG. 1) and drilling the wellbore may then resume.

It may also be possible, as will be explained with reference to FIGS. 5 and 6, to remove the entire drill pipe 18A from inside the casing 18B when the upper connection 18D is accessible as shown in FIG. 3A. Such may be performed, for example, when drilling the wellbore is completed, or if it should be necessary to change a component of a drilling tool assembly disposed below the bottom of the casing (FIG. 4 and FIG. 7).

It should also be understood that the type of connection between casing joints is not a limitation on the scope of the present disclosure. A joint of casing may threadedly coupled to a casing collar or to threads on an adjacent casing joint, depending on the type of casing used. The casing, which as explained above may be the outer pipe (18B in FIG. 2) may comprise double ended external threaded joints connected by collars, may be flush joint internal/external threaded joints coupled end to end, or may be upset internal/external threaded joints.

Figure 4:
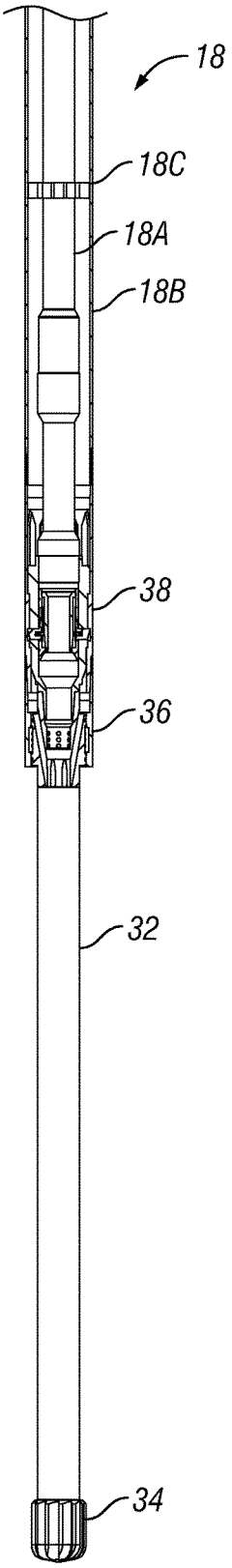
FIG. 4 shows an example of bottom hole components of a casing drilling system.

FIG. 4 shows a lower end of the combination conduit 18 and components assembled thereto to better understand casing drilling using a method and system according to the present disclosure. The lowermost joint of the casing 18B and the drill pipe 18A are connected to a casing adapter 38. The casing adapter 38 may provide one or more of the following functions, as will be further explained with reference to FIGS. 5 and 6. The casing adapter 38 may provide torque transmission between the casing 18B and the drill pipe 18A. The casing adapter 38 may provide a lower termination of the casing 18B beyond which extends a drilling tool assembly. The drilling tool assembly may include a drill bit 34 of any type known in the art, a bottom hole assembly (BHA) 32 and a flow crossover 36. The BHA 32 may include, without limitation, measurement while drilling tools, logging while drilling tools, stabilizers, hydraulic motors, reamers and drill collars. The casing adapter 38 may also have a releasable locking mechanism (FIGS. 5 and 6) to prevent relative axial movement between the drill pipe 18A and the casing 18B. Such feature may enable application of substantial axial force on the drill bit 34 without resulting in relative movement between the casing 18B and the drill pipe 18A.

Figure 5:
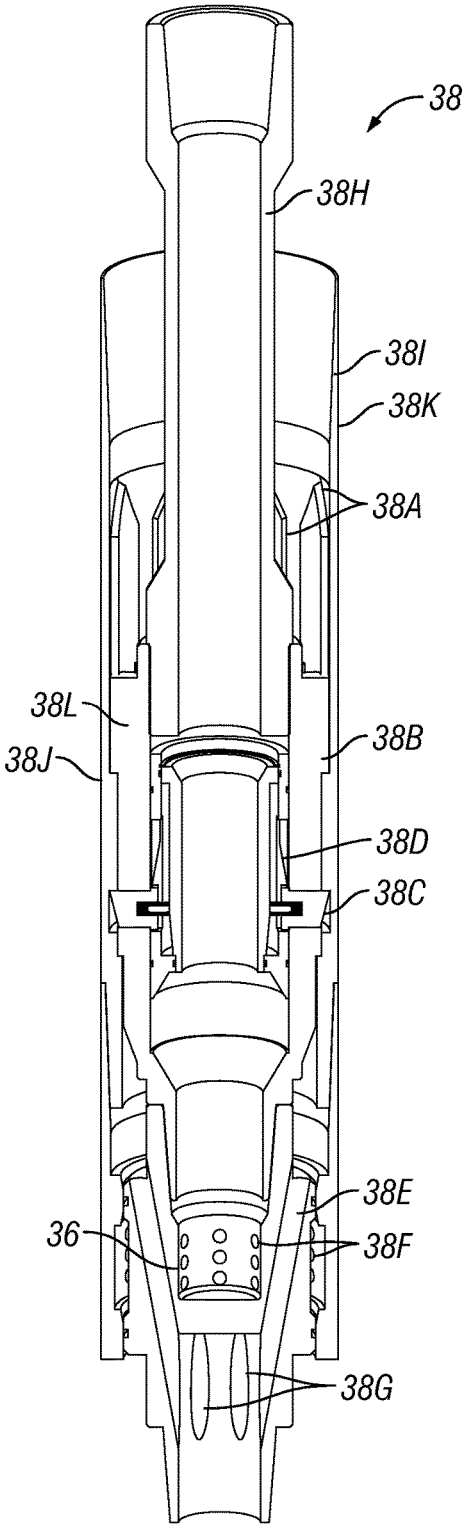
FIG. 5 shows an example casing adapter in a locked position.
Figure 6:
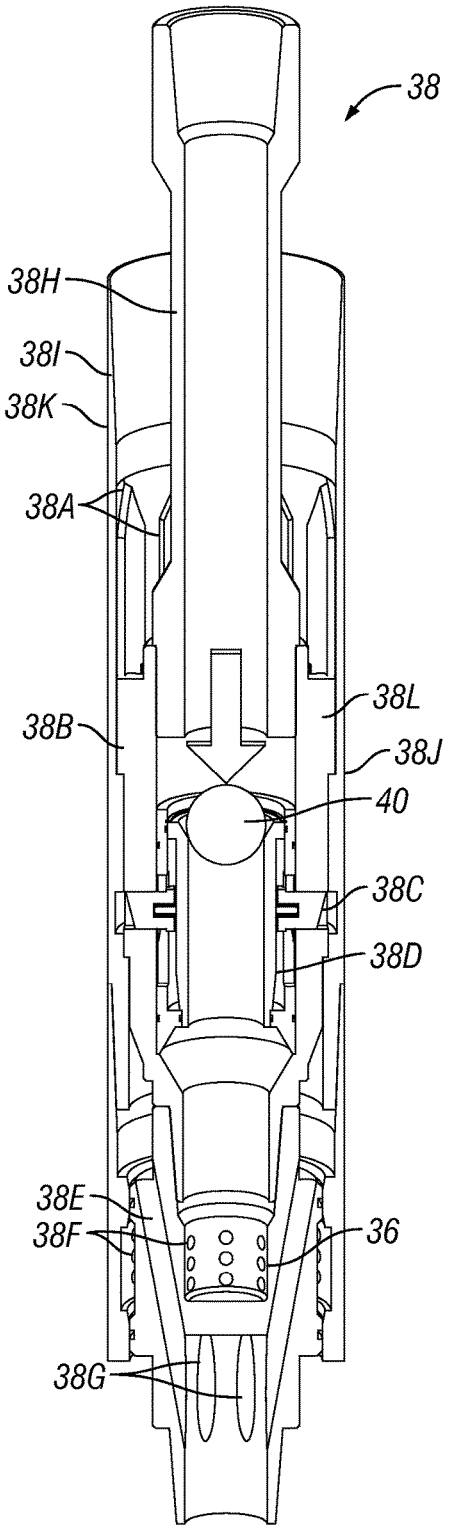
FIG. 6 shows the example casing adapted being unlocked to enable removal of a drill pipe string and bottom hole assembly.
Figure 7:
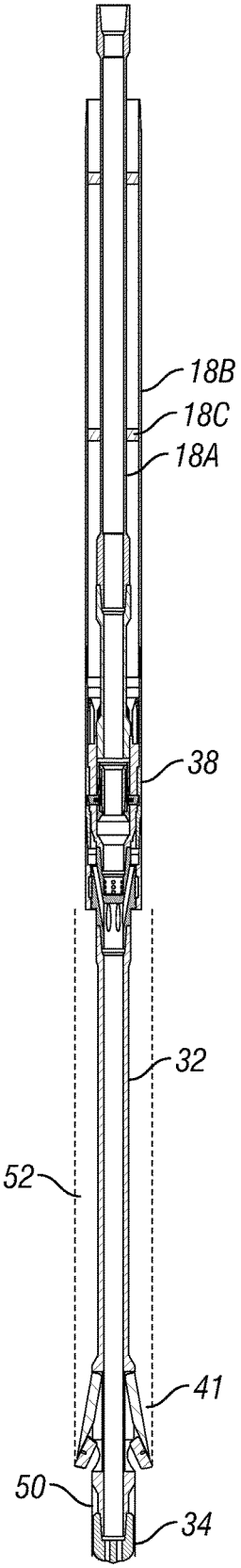
FIG. 7 shows an example bottom hole assembly coupled to a casing adapter.

FIGS. 5 and 6 show the casing adapter 38 in the locked position and unlocked position, respectively, along with details of the flow crossover 36. The casing adapter 38 may include a housing 38K having a connector 381, such as a threaded connector, configured to be assembled to the lowermost joint of the casing (18B in FIG. 4). A drill pipe adapter 38H is configured to connect to the lowermost joint of the drill pipe (18A in FIG. 4). The casing adapter housing 38K interior surface, and an outer surface of the drill pipe adapter 38H may include corresponding splines 38A or other torque transmitting features such that rotational energy applied to the casing 18B from the top drive (14 in FIG. 2) may be communicated from the casing adapter housing 38K and thus to the drill pipe (18A in FIG. 4). A drill pipe adapter locking base 38L may include a shoulder 38B that cooperates with a mating shoulder 38J formed in the inner surface of the casing adapter housing 38K. The corresponding shoulders 38B, 38J prevent the drill pipe adapter 38H from moving downwardly within the casing adapter housing 38K.

In the locked configuration shown in FIG. 5, spring loaded wedges 38C may be urged outwardly into features formed into the inner surface of the casing adapter housing 38K. In such configuration, the drill pipe adapter 38H is prevented from moving upwardly within the casing adapter housing 38K.

To release the drill pipe adapter 38H from the casing adapter housing 38K such that upward movement of the drill pipe adapter 38H and thus the flow crossover 36 (and the drilling tool assembly shown in FIG. 4 for retrieval from the casing (18B in FIG. 4), a ball 40 may be dropped into the interior of the drill pipe (e.g., when exposed as explained with reference to FIG. 3A). The interior of the drill pipe may be pressurized, causing a wedge activator 38D to move downwardly, e.g., against spring pressure. The wedge activator 38D may include external features as shown to pull the wedges 38C inwardly, thus disengaging them from the interior surface of the casing adapter housing 38K. The drill pipe adapter 38H, flow crossover 36 and anything connected below the flow crossover as shown in FIG. 4 may then be pulled upwardly through the casing adapter housing 38K and ultimately through the casing (18B in FIG. 4).

The flow crossover may include ports 38E for diverting down flowing drilling fluid inside the casing adapter housing 38K and outside the drill pipe adapter 38H into the interior of the lower portion of the flow crossover 36, shown as holes 38G. Drilling fluid flowing into the bottom of the casing adapter housing 38K from below it may be diverted through holes shown at 38F into the interior of the drill pipe adapter 38H, and thereafter into the interior of the drill pipe (18A in FIG. 4).

FIG. 7 shows another example of a BHA 42 which includes an expandable underreamer 41. During insertion and/or removal of the drill pipe from inside the casing, the underreamer 41 may be in a retracted position and have an external diameter at most equal to the external diameter of the drill bit 34. Such retracted diameter may enable free movement of the entire BHA 42 into and out of the casing 18B and casing adapter 38 as may be necessary during drilling operations and when drilling is completed and it is desired to permanently remove the drill pipe 18A and BHA 42 from the casing 18B.

During casing drilling operations, wherein the wellbore is lengthened by the drill bit 34, the underreamer 40 may be expanded to enlarge the diameter of the wellbore (shown at 50 with bit diameter) to at least the outer diameter of the casing, shown at 52, so that the casing 18B can move freely into the wellbore as the wellbore 52 is lengthened.

After the wellbore is drilled and the casing is moved to a desired depth, the drill pipe, underreamer, BHA and drill bit may be removed from the casing and the casing may be cemented in the wellbore using any known cementing technique applicable to the particular wellbore.

In other examples, the drill bit 34 may have a drill diameter selected to enable free passage of the casing 18B. In such examples, the drill bit 34 and BHA 42 may be preassembled to the casing adapter 38 with the intention of leaving the drill bit 34 in the wellbore after drilling is completed. In such examples, the BHA and drill pipe 18A may be retrieved as explained above by having any known type of release latch coupled between the BHA 42 and the drill bit 34 (e.g., activated by dropping a suitable diameter ball and pressuring the interior of the drill pipe 18A), or a conventional casing/tubing cutter such as a jet cutter or chemical cutter may be used to sever the bit 34 from the BHA 42, or to sever the drill pipe 18A at any other suitable position for removal above the severed portion.

Using a system as explained above, drilling fluid discharged though the drill bit 34 as is ordinarily performed in drilling operations, may be returned through, e.g., the annular space between the drill pipe and the casing. Such fluid return may improve cuttings removal (hole cleaning) by increasing the velocity of the returning drilling fluid in which drill cuttings are suspended, and may reduce the possibility of cuttings becoming lodged in the annular space between the wellbore wall and the exterior of the casing. The foregoing may reduce the possibility of the casing becoming stuck in the wellbore and may increase the possibility that the well may be cased and drilled simultaneously to its intended total depth. Using a system as explained above may also provide the ability to maintain constant pressure in the wellbore to avoid washouts and dynamic pressure changes along the wellbore wall outside the casing. The system may also provide the ability to create buoyancy of the casing to significantly reduce the friction, torque and drag. Casing buoyancy is obtained by using a higher fluid density in the wellbore outside of the casing than the density of fluid circulated inside the casing.

It is also possible to use a casing drilling system according to the present disclosure in a fully or partially pre-drilled wellbore, simply as a method for inserting the casing therein. The casing drilling system used in such manner may then have a very simple BHA. In some examples, the BHA may be only a reamer/drill bit at the end.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A casing drilling system, comprising:

a combination conduit comprising a casing and a pipe inside the casing;

a first adapter having a flow diverter to redirect at least flow of drilling fluid returning from a bottom of a wellbore to an interior of the pipe;

a second adapter having a flow diverter to redirect flow of drilling fluid into an upper end of the combination conduit through the annular space between the pipe and the conduit, the second adapter having a rotatable fluid connection between the at least one of the interior of the pipe and the annular space and a rotationally fixed fluid outlet for the returning drilling fluid; and a casing chuck having means to support axial loading of the casing and a slidable conduit operable to expose an uppermost end of the casing and a connection between the second adapter and an uppermost end of the pipe.

2. The system of claim 1 wherein the pipe comprises threadedly coupled segments of drill pipe.

3. The system of claim 1 wherein the slidable conduit on the casing chuck is operable by pressurizing an interior space between an upper end of the slidable conduit and a flanged coupling extending from the second adapter.

4. The system of claim 1 wherein the second adapter is threadedly coupled to a quill of a top drive.

5. The system of claim 1 wherein the means to support axial loading comprises an internal gripper having pipe slips.

6. The system of claim 1 further comprising centralizers disposed at axially spaced apart locations between the pipe and the casing.

7. The system of claim 1 further comprising a bottom hole assembly coupled to the pipe below the first adapter.

8. The system of claim 7 wherein the bottom holes assembly comprises a reamer at a bottom end of the casing.

9. The system of claim 7 wherein the bottom hole assembly comprises a drill bit having a diameter enabling free passage through an interior of the casing.

10. The system of claim 9 wherein the drill bit has a diameter enabling free passage of the casing through a wellbore drilled by the drill bit.

11. The system of claim 9 wherein the bottom hole assembly comprises an underreamer diametrically expandable to enlarge a diameter of a hole drilled by the drill bit to a diameter enabling free passage of the casing therethrough, the drill bit having a diameter selected to enable free passage through an interior of the casing.

12. The system of claim 11 wherein the underreamer is diametrically contractable to enable free passage through an interior of the casing.

13. The system of claim 1 wherein the first adapter comprises a releasable locking mechanism to prevent axial movement of the pipe relative to the casing, the locking mechanism when released enabling withdrawal of the entire pipe from inside the casing.

14. The system of claim 1 wherein the first adapter comprises at least one torque transmission feature such that rotational energy applied to the casing is communicated to the pipe.

* * * * *